US005111942A

United States Patent [19]

Bernardin

[11] Patent Number: 5,111,942

[45] Date of Patent: May 12, 1992

[54] DISPLAY TRAY FOR ALIGNED ARTICLES

[76] Inventor: Didier Bernardin, 60 Rue de Varenne, 75007 Paris, France

[21] Appl. No.: 691,385

[22] Filed: Mar. 25, 1991

[30] Foreign Application Priority Data

Apr. 25, 1990 [FR] France ..... 90 05276

[51] Int. Cl.[5] ..... A47F 7/00

[52] U.S. Cl. ..... 211/59.3; 312/61

[58] Field of Search ..... 211/59.3, 59.2; 312/42, 312/60, 61, 71

[56] References Cited

U.S. PATENT DOCUMENTS

| | | | |
|---|---|---|---|
| 2,750,049 | 6/1956 | Hunter | 211/59.3 |
| 4,269,326 | 5/1981 | Delbrouck et al. . | |
| 4,454,948 | 6/1984 | Spamer | 211/59.2 |
| 4,651,883 | 3/1987 | Gullett et al. . | |
| 4,762,236 | 8/1988 | Jackle, III et al. | 211/59.3 |
| 4,830,201 | 4/1989 | Breslow | 211/59.3 X |
| 4,953,748 | 9/1990 | Wheelock | 312/61 X |

FOREIGN PATENT DOCUMENTS

| | | |
|---|---|---|
| 906083 | 4/1987 | Belgium . |
| 0004921 | 10/1979 | European Pat. Off. . |
| 2617385 | 1/1989 | France . |

*Primary Examiner*—Robert W. Gibson, Jr.
*Attorney, Agent, or Firm*—Young & Thompson

[57] ABSTRACT

A channel is adapted to receive partly nested objects in a queue which a clamp/pusher member associated with a return spring urges towards an anterior abutment wall; the pusher member is associated with a slide member sliding in a central guide corridor, while the return spring forms at least one outward run in each of the two side passages between at least one direction-changer pulley wheel and an anchor point. A plurality of merchandisers may be mounted on a strip member for the purposes of aligning the merchandisers with the shelving and securing them to it.

17 Claims, 6 Drawing Sheets

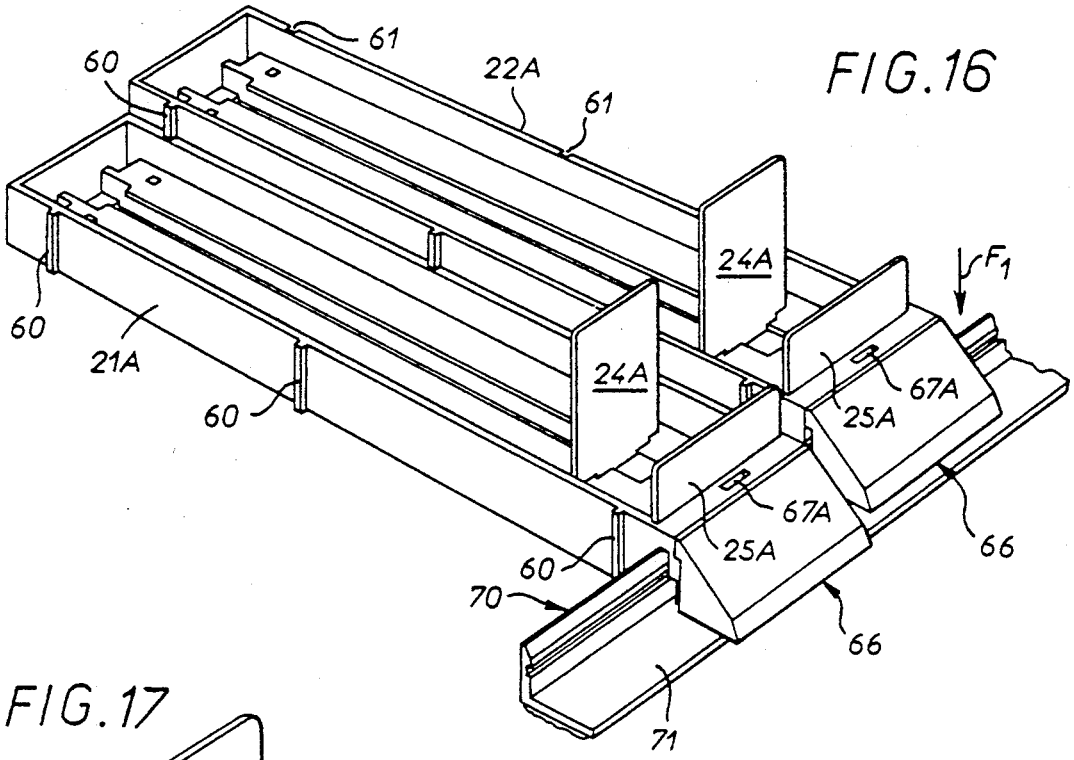
FIG. 16
FIG. 17
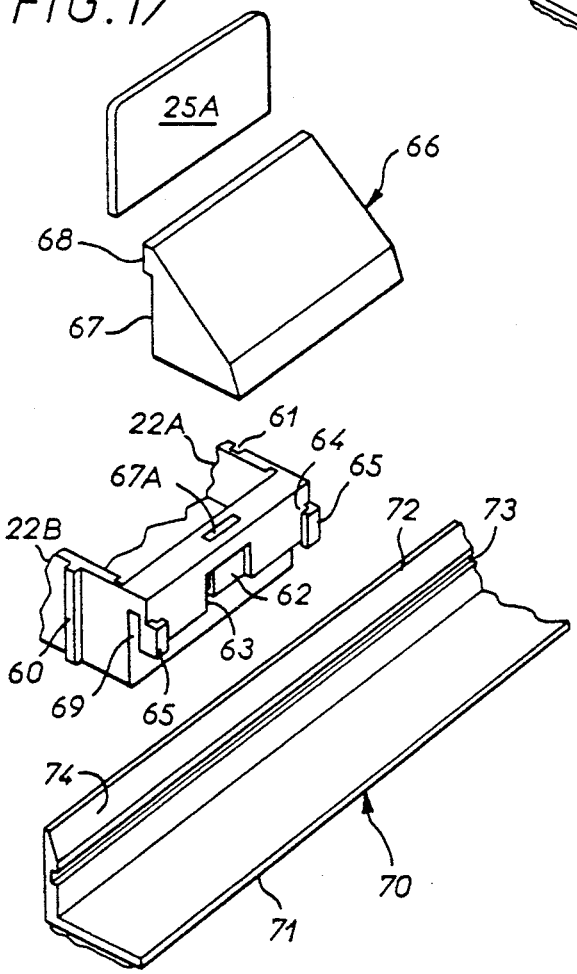
FIG. 18
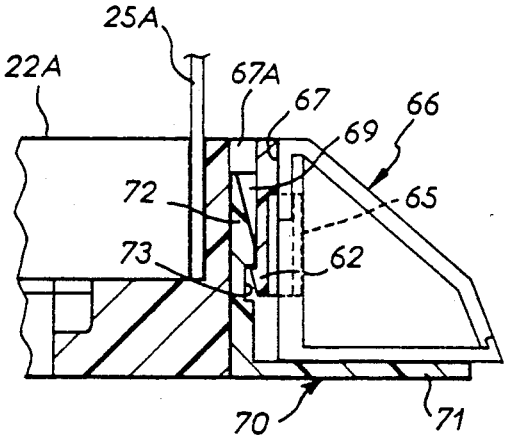

DISPLAY TRAY FOR ALIGNED ARTICLES

The present invention concerns display trays for aligned articles of the kind comprising a channel adapted to receive a queue of objects partially nested within it, the channel being provided with a clamp-/pusher member attached to a foot member adapted to slide in a guide slot and associated with a return spring urging it towards an anterior abutment wall.

Merchandisers of this kind are increasing used in so-called linear shelving, especially in supermarket and hypermarket type retailing outlets. The merchandisers currently available on the market have certain drawbacks, however.

One problem results from the magnitude of the displacement required of the clamp/pusher member between the position with the merchandiser fully loaded and the position with the merchandiser empty, movement over this distance having to be achieved without excessive variation in the clamping force applied to the articles presented. This force must remain sufficiently high to hold the articles properly but limited to prevent damage to the articles and to avoid the need for prospective purchasers to apply excessive force to remove an article to examine it and then to replace it on deciding not to purchase it.

It often happens that prospective purchasers fail to return the article to the queue from which it was taken, which causes untidiness which impedes effective running of a store.

The existing devices for guiding and returning the clamp/pusher member carried by a sliding member have various drawbacks.

Firstly, these devices suffer from a lack of flexibility in that they have limited possibilities of extending the length of the merchandiser, the spring extending in a single line between the sliding member and its anchor system.

The presence of the spring in a central passageway introduces the risk of the sliding member jamming.

A general object of the invention is to provide a remedy for these problems by virtue of a set of improvements with reference to the conditions of manufacture and of use of merchandisers of the type in question, and in particular by increased flexibility of use through reducing the risk of jamming between the spring and the sliding member when the latter moves.

According to one improvement proposed to this effect, the foot member of the clamp/pusher member is attached to a slide member disposed in a central guide passage underneath the channel, the return spring being coupled to the slider member, two lateral passages being provided to either side of the central passage, the return spring describing at least one outward run in each of the side passages between at least one direction-changer pulley wheel and an anchor point.

In one preferred embodiment of the invention the central passage and the side passages are defined by intermediary side walls or partitions. These walls or partitions are optional and are not essential to obtaining the results and advantages of the present invention.

In one embodiment said return spring describes an outward and a return run in each of said side passages.

In all embodiments the flexibility of operation is enhanced by virtue of the runs of the springs in each of the two side passages. Similarly the risk of jamming is reduced by the fact that the spring runs are in the side passages and therefore laterally offset from the central passage.

The direction-changer pulley wheel for the return spring in each of the side passages is preferably horizontal, in other words journalled on a vertical axis. This can reduce the overall height of the system by a flat arrangement of the spring and its direction-changer pulley wheels in a generally horizontal plane which also contains the carriage coupling member.

The slide member is advantageously mounted, in one specific embodiment of the invention, on balls or rollers adapted to cooperate with the intermediary side walls forming the central guide passage to offer improved sliding motion.

In another, simplified embodiment, said slide member is provided with angle-irons adapted to cooperate with slideways provided on the walls of said central passage to procure guided sliding. In this case it goes without saying that the tolerances are chosen to avoid any jamming of said slide member in the guide slot.

Another problem with known merchandisers results from the great variation in the depth or width of shelving or other supports used, with the frequent need to manufacture merchandisers specific to one type of application.

The present invention proposes a modular merchandiser design characterized by the combination of a basic module with a variable number of extension modules.

One arrangement in accordance with the invention entails providing in front of the front wall of the merchandiser channel a spare location adapted to receive an article separated from the queue. The main advantage of this extremely simple arrangement is to offer the customer who has taken an article from the queue the facility to put it down in an extremely convenient place in that this place is immediately accessible and in that the article can be put into it directly. This is also convenient because the article is then at the front of a line of similar articles which are still tightly clamped in the queue.

Finally, in one advantageous embodiment the central passage has at its rear end an opening allowing the carriage (slide member and pusher member combination) to be removed by tilting it, for possible replacement, while allowing the carriage to move as far as the rear wall of the merchandiser without risk of it becoming accidentally separated from the merchandiser.

In another aspect the invention provides a set of queued object merchandisers each comprising a channel adapted to receive a partly nested queue of objects, a generally L-shaped strip member comprising a substantially horizontal flange adapted to be fixed to the shelving and a substantially vertical flange adapted to be inserted into a slot formed in the front part of each of the merchandisers in order to hold them aligned with each other along the shelving, snap-fastener means being provided in communication with the slot or adapted to cooperate with a groove formed in the vertical flange in order to enable each of the merchandisers to be snapfastened onto the strip member.

The characteristics and advantages of the invention will emerge from the following description given by way of example with reference to the appended drawings in which.

Figure 15C:
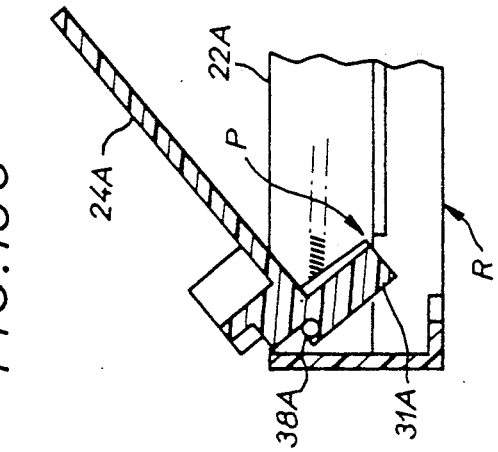
Figure 15B:
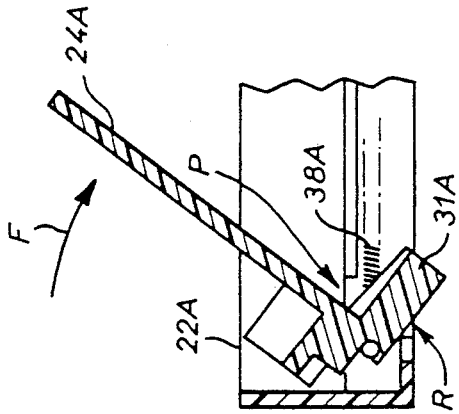
Figure 15A:
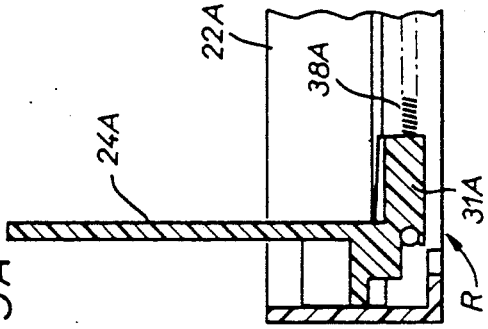

FIGS. 15A, 15B, and 15C are schematic views showing the extraction of the carriage from the guide slot of the merchandiser in successive stages.

FIG. 16 is a perspective view of two merchandisers as shown in FIGS. 10 through 15, one of which it attached to a strip member and the other of which is being fitted.

FIG. 17 is an exploded view to show the front part of one of the merchandisers from FIG. 16.

FIG. 18 is an enlarged view in cross-section on the line XVIII—XVIII of FIG. 16.

Referring to the first embodiment shown in FIGS. 1 through 6, a merchandiser in accordance with the invention has a casing comprising a base module 10 and a variable number of extension modules 11, 12, etc. The length of each extension module represents a fraction (one third, for example) of the base module.

Figure 1:
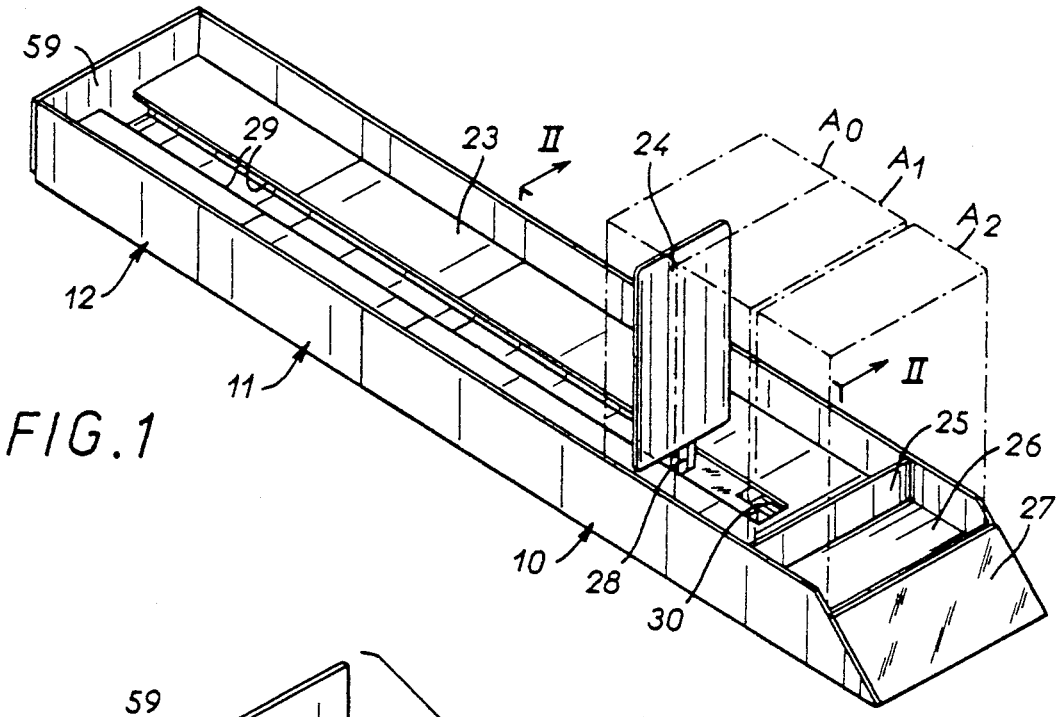
FIG. 1 is a perspective view of a merchandiser.
Figure 6:
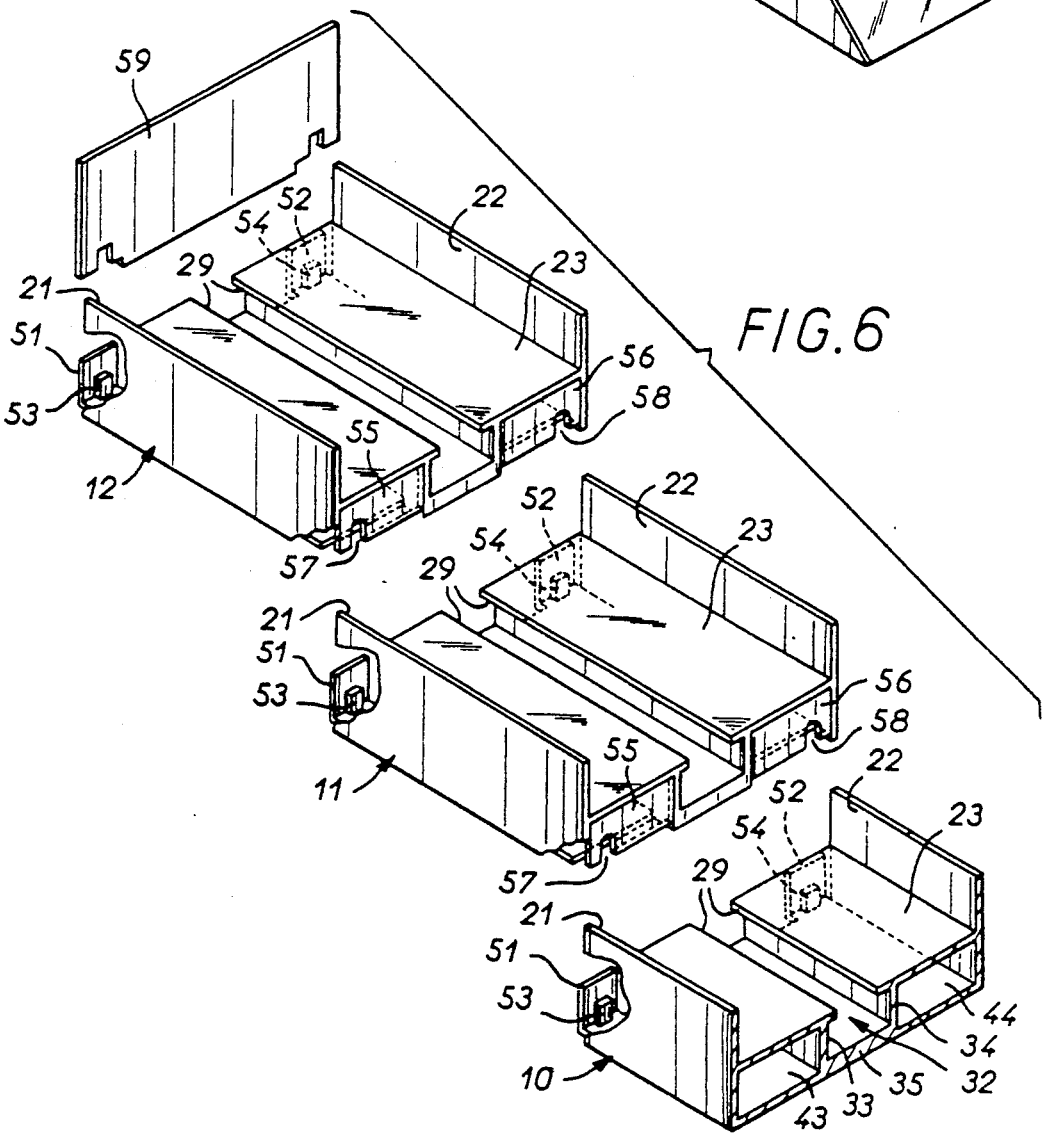
FIG. 6 is an enlarged perspective view of two modules separated from the base module.
Figures 2, 3, 3A, 4, 5:
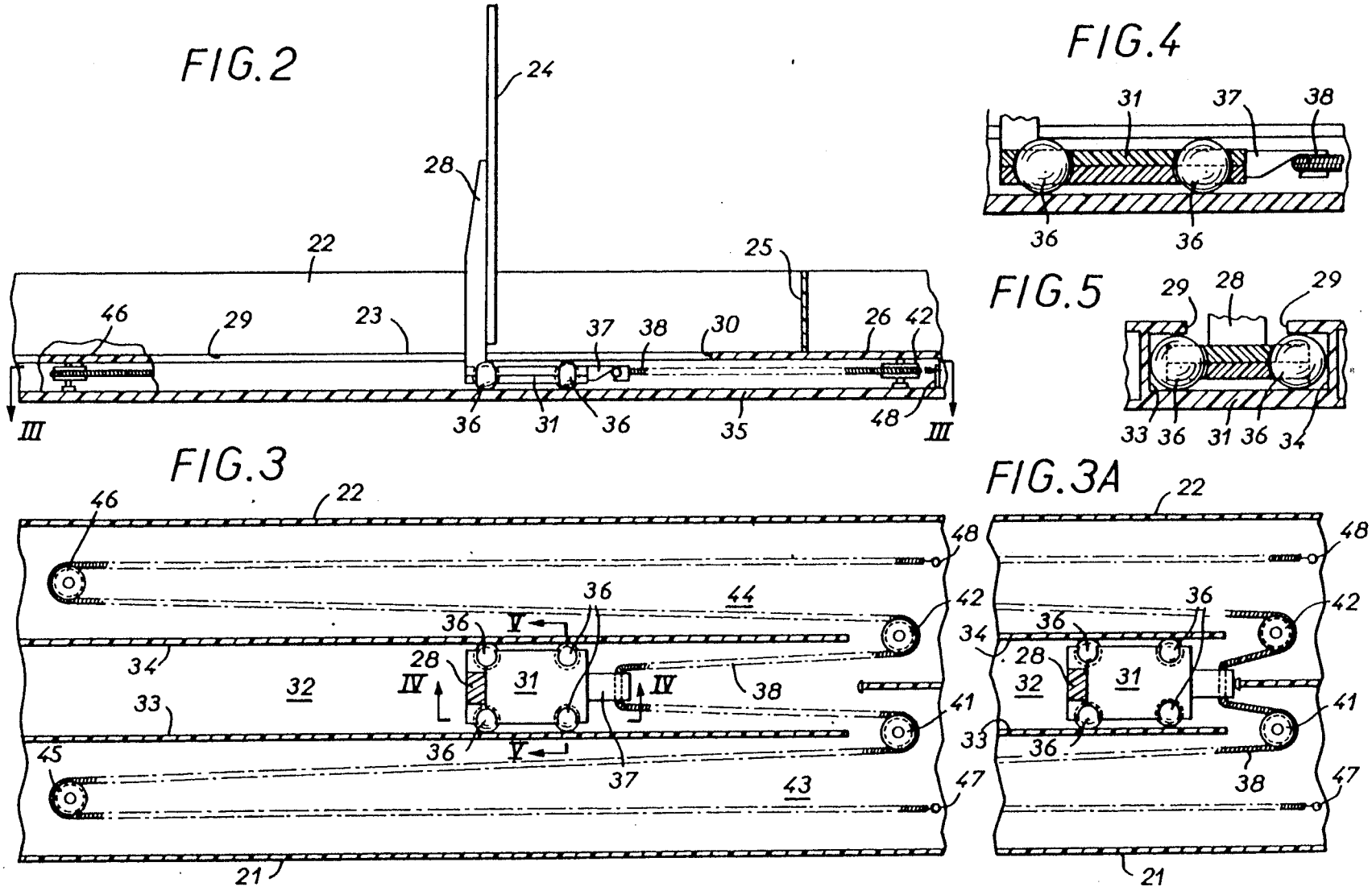
FIG. 2 is a view in cross-section on the plane II—II of FIG. 1.
FIG. 3 is a view in cross-section on the plane III—III of FIG. 2.
FIG. 3A shows the carriage at the end of its travel with no objects in the merchandiser channel.
FIG. 4 is a view in cross-section on the plane IV—IV of FIG. III.
FIG. 5 is a view in cross-section on the plane IV—IV of FIG. 3.

The main part of each module comprises, as is most clearly seen in FIG. 6, an active part in the form of a channel delimited by two sidewalls 21, 22 above a bottom 23 for articles like those shown in chain-dotted line at A0, Al, A2, etc. These articles are parallelpiped-shaped for example, and are partially nested in the channel one behind the other. The queue (horizontal row) of articles formed in this way is pushed by a clamp/pusher member 24 against an anterior wall 25 forming an abutment member which is fixed in this case and in front of which there is provided, according to one subsidiary feature of the invention, a location 26 for an article such as the article A2 that a prospective purchaser may have removed from the merchandiser and may not wish to take the trouble to put back behind the anterior wall. This location is immediately behind an inclined information surface 27 conventionally provided at the front of the merchandiser. The clamp/pusher member 24 is carried by a foot member 28 adapted to slide freely in a central guide slot 29 centrally located on the bottom 23 of the channel and extending to the rear end of the merchandiser from a point of origin near the abutment wall 25. The foot member 28 of the pusher member is fastened to a slide member 31 adapted to slide freely in a central passage 32 defined by two intermediate side walls 33 and 34 and a bottom wall 35. In this embodiment the slide member 31 is a carriage adapted to roll on four balls 36 and incorporating a hook 37 to which a return spring 38 is attached. In this embodiment the spring runs around the exterior of a pair of direction-changer pulley wheels 41 and 42 disposed near the anterior end of the merchandiser to define an out and return path on each side of the merchandiser, one in each of the two side passages 43 and 44, passing also around two posterior direction-changer pulley wheels 45 and 46 before returning to two anterior anchor points 47 and 48. The anchor points 47 and 48 and the anterior direction-changer pulley wheels 41 and 42 can advantageously be located under the location 26 for receiving a single article.

The overall length of the spring 38 when unstretched may therefore be substantially four times the length of the base module 10, so that the spring stretches to accommodate movement of the clamp/pusher member 24 from the front to the rear of the base module by not more than 25% of its unstretched length. As it can be stretched without difficulty by up to 100% and more, the displacement of the clamp/pusher member can continue to a multiple of the base module length. This facility is exploited in accordance with the invention by disposing at the end of the base module a variable number of extension modules 11, 12, etc.

Aligned with each of the side passages 43 and 44 of the base module is a retaining lug 51 and 52, each of which carries a projecting stud 53 and 54 facing towards the corresponding passage. Each extension module has at the front of the two side passages partition members 55 and 56 respectively adapted to fit behind the lugs 51 and 52 with notches 57 and 58 adapted to fit over the corresponding studs 53 and 54.

Similar retaining lugs 51 and 52 with studs are provided at the rear of each of the extension modules, so that these can be used to extend the base module to a variable degree.

The posterior end of the merchandiser formed in this way is closed by an end plate 59 adapted to close off the channel 23 and the passages 32 and 43 and 44 and to fit over the lugs and studs of the final module of the merchandiser.

Figure 9:
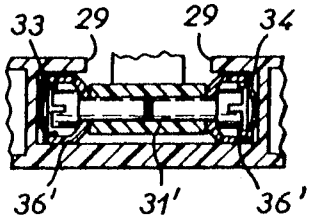
FIG. 9 is a view in cross-section on the plane IX—IX of FIG. 7.
Figure 7:
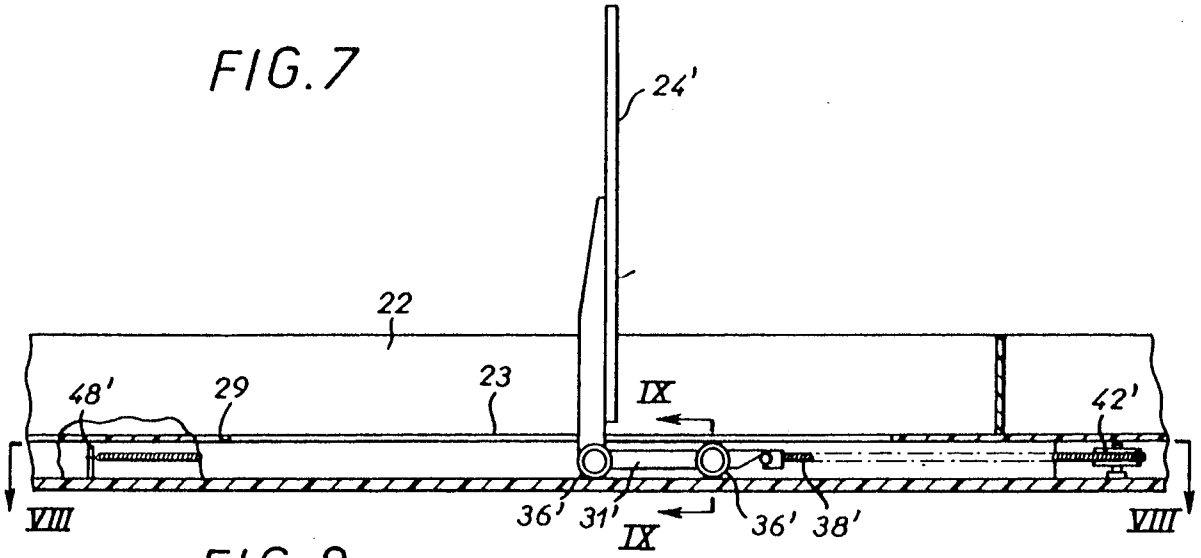
FIG. 7 is a view similar to that of FIG. 2 relating to an alternative embodiment.
Figure 8:
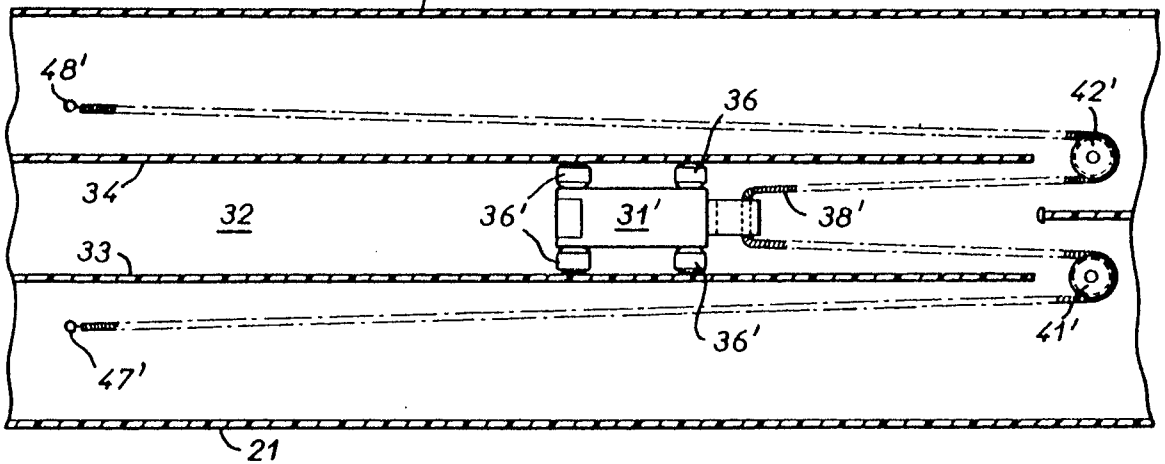
FIG. 8 is a view in cross-section on the plane VIII—VIII of FIG. 7.
Figure 10:
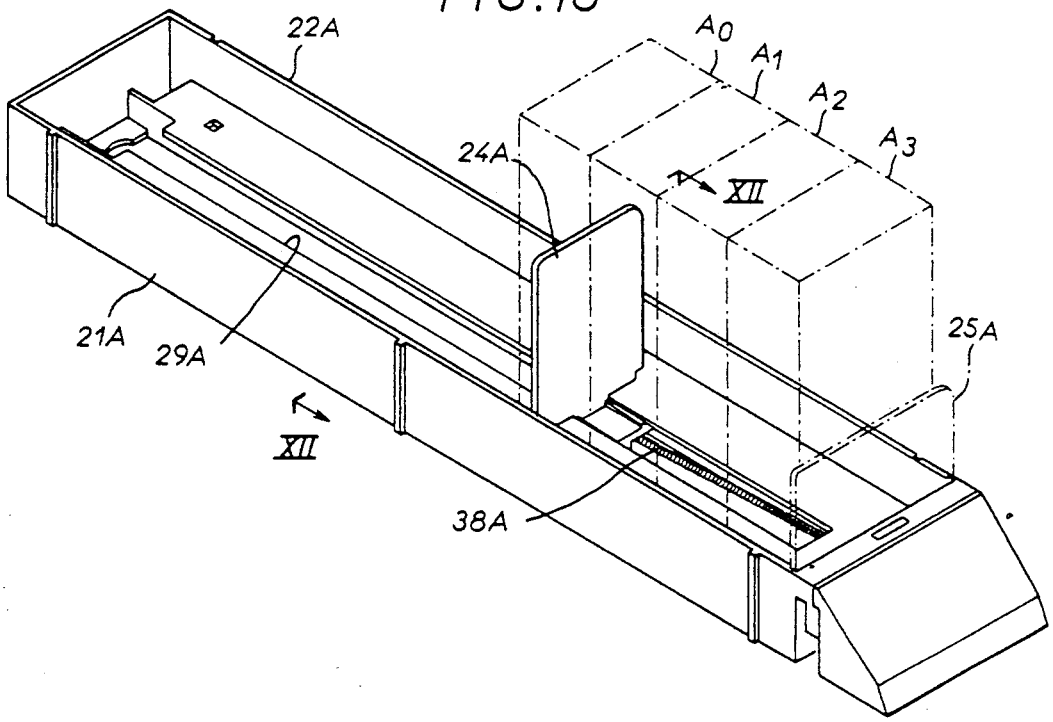
FIG. 10 is a view similar to that of FIG. 1 relating to an alternative embodiment.
Figure 11:
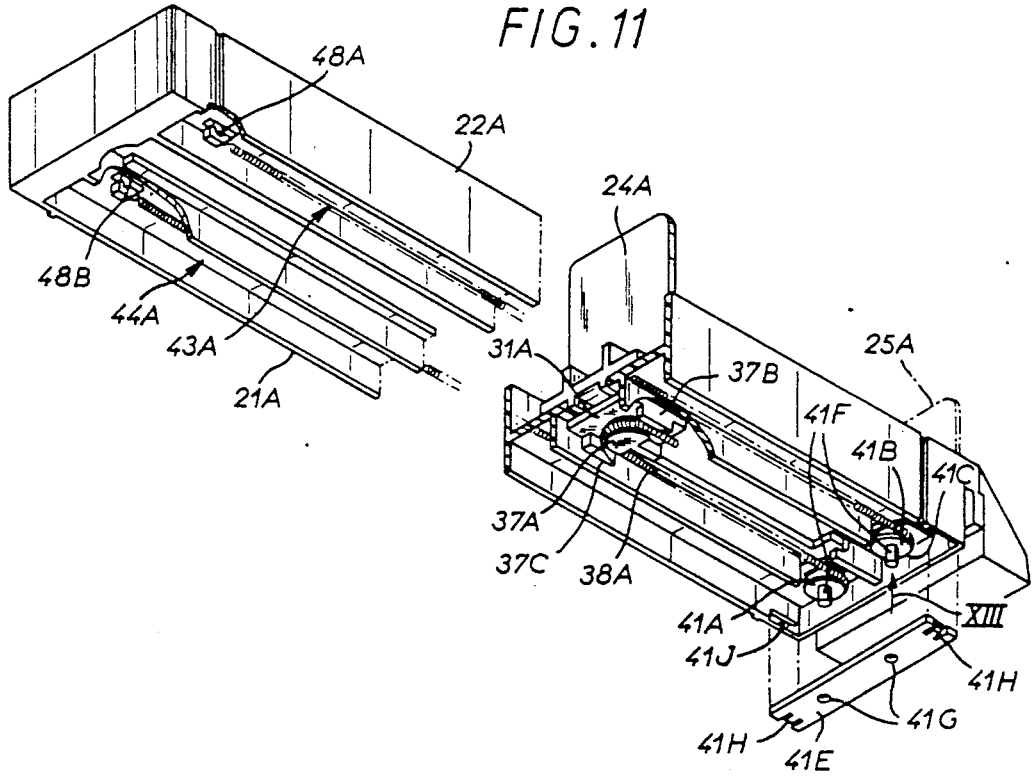
FIG. 11 is a bottom view of the embodiment shown in FIG. 10.

FIGS. 7 through 9 show an embodiment which is simplified in respect of the structure of the slide member 31'. Here the slide member 31' is a carriage-plate provided with four rollers 36' free to rotate on shafts each in the form of a screw cooperating with a screwthread formed for this purpose in the plate 31'. Domed plugs capping the open sides of the four rollers are adapted to cooperate with the side walls of the central passage.

In this embodiment the return spring 38' is fixed at its end to the two fixed points 47' and 48' provided in the respective side passages near their posterior end (not shown), direction-changer pulley wheels 41' and 42' being disposed between the coupling to the carriage 31' and the fixed point 47' and 48' in alignment with the intermediary side walls 33 and 34. This defines a single out run in each of the side passages between said fixed points near the posterior wall and said pulley wheels beyond the anterior wall 25 and near an information compartment covered by the information plate 29.

In an arrangement like this the total unstretched length of the return spring 38' is substantially twice the length of the base module which in this instance itself forms the casing of the merchandiser, so that the extension representing movement of the clamp/pusher member to the rear of the single module does not exceed some 50% of the unstretched length. This is sufficient to obtain the required flexibility of operation, especially if the merchandiser casing is a single module.

Referring now to the embodiment of FIGS. 10 through 15, the slide member 31A of the clamp/pusher member 24A has a profile with angle-irons 36A extending laterally outwards and adapted to cooperate with the slideways 29A and 29B of the central passage 32.

The bottom surface of the slide member 31A carries a semi-circular direction-changer guide with a peripheral groove 37A, in the general shape of half a pulley wheel and providing a link between the slide member 31A and the return spring 38A which is fixed at both ends to two fixed attachment points 48A and 48B near the posterior wall of the merchandiser and at the opposite end from the direction-changer pulley wheels 41A and 41B near the anterior abutment wall 25A. Attachment points 48A and 48B of the corresponding direction-changer pulley wheels 41A and 41B are located in the two side passages 43A and 44A.

The anterior abutment wall 25A is a removable plate inserted into grooves formed on the inside surfaces of the side walls 21A and 22A. This abutment wall has one part extending well beyond the top edge of the casing of the merchandiser and is therefore able to prevent accidental tilting of the article at the front of the queue in the case illustrated when the article A3 is relatively tall.

The semi-circular configuration has the advantage of applying less stress to the return spring 38A than the coupling means shown in FIG. 8, which involves two much more accentuated changes of direction. To either side of the semi-circular direction-changer guide 37A are symmetrically disposed lateral retainer abutments 37B and 37C. Each of the retainer abutments 37B and 37C has a straight rear part parallel to the longitudinal axis of the merchandiser spaced from the external periphery of the semi-circular guide by a lateral distance less than the diameter of the return spring 38A and a front part inclined laterally outwards from the rear area. Because of the arrangement of the rear areas of the retainer abutments the spring cannot become disengaged from the slide member in normal operation. At assembly time the technician must force fit parts of the return spring through the narrow gap between the semi-circular guide and the retainer abutments.

Figure 13:
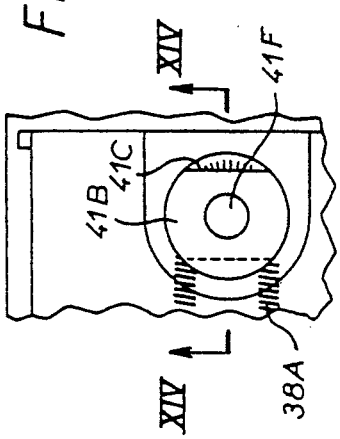
FIG. 13 is an enlarged view as seen in the direction of the arrow XIII of FIG. 11.
Figure 14:
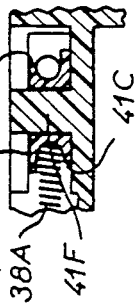
FIG. 14 is a view on the plane XIV—XIV of FIG. 13.
Figure 12:
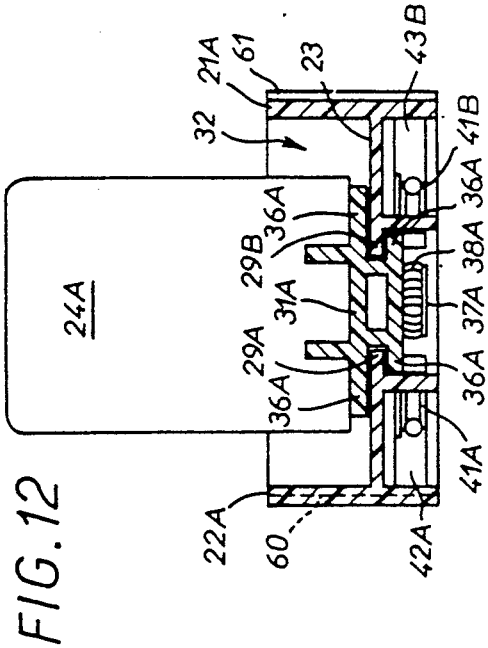
FIG. 12 is a view in cross-section on the plane XII—XII of FIG. 10.

As shown in FIGS. 13 and 14, the pulley wheels 41A and 41B have flats 41C in each flange which facilitate mounting the spring 38A and enable the pulley wheel itself to be mounted on its fixed axis 41F either way around.

It will be understood that with this arrangement and with the spring fitted in this way it is possible to apply calibrated return forces in direct proportion to the unstretched length of the spring.

Each of the pulley wheels 41A and 41B is free to rotate on its fixed shaft 41C extending downwards from the bottom of the merchandiser. A retainer plate 41E includes holes 41G adapted to receive fixed shafts 41F. The retainer plate has at its lateral ends snap-fastener means in the form of spring tangs 41H adapted to snap into complementary recesses 41J at the center of apertures on the inside surface of the outside side wall 21A, 22A. When the retainer plate 41E is nested within the outer side walls, it is flush with the bottom edge of the merchandiser. Each retainer plate can be removed to obtain access to the pulley wheels 41A and 41B to demount the return spring 38A but at normal times holds the pulley wheels 41A and 41B in place on the shaft 41D.

The invention makes provision for extracting the clamp/pusher member 24A and its slide member 31A in order to replace them and/or the return spring 38A. To this end the slide member forms the two branches of an L (see FIGS. 15A and 15C) and a slot P is formed at the rear end of the guide slot 29A at the bottom of the central passage 32 over an open area R in the bottom of the merchandiser. It is then sufficient to move the combination 24A/31A to the rear end of the guide slot 29A, in line with these apertures (FIG. 15A), to pivot it in the direction of the arrow F (FIG. 15B) and then to lift it out (FIG. 15C). The spring is then easy to detach at each end and the slide member with its clamp/pusher member may be changed. The same applies to the return spring, if necessary.

In the end of travel position shown in FIG. 15A the slide member is abutted against the posterior wall of the module, the front branch of the flange of the slider member 31A being located under the bottom of the central passage of the merchandiser. This arrangement avoids removal by an unauthorized customer or employee or other person of the clamp/pusher member/-slide member assembly from the merchandiser casing. To remove the pusher member/slide member assembly the user must be familiar with the tilting maneuver described above.

In the embodiment of FIGS. 16 through 18 a set of merchandisers are provided, two of which are shown, side by side. The outside surface of one of the side walls 21A of each of the merchandisers, which are of the type shown in FIG. 10 through 15, for example, carries longitudinally spaced ribs 60, of which there are three as shown here, and on the outside surface of the other side wall 22A are grooves 61 adapted to receive these ribs and, of course, spaced by the same distance as the ribs. The nesting of the ribs 60 within the grooves 61 aligns the plurality of merchandisers accurately but without retaining them to the shelving. These arrangements are known in themselves.

There is further provided in this embodiment at the front end of each merchandiser a latch 62 disposed in a notch 63 of a front wall 64 of the merchandiser projecting cantilever fashion relative to the casing proper. The latch is formed in the thickness of the front wall. On each side of the front wall 64 are angle-iron shape hooks 65 extending vertically and facing each other, adapted to receive between them and the front wall 64 the rear wall 67 of a known type information compartment 66.

The information compartment 66 has a removable front wall with a dihedral angle defining an inclined upper area adapted to show a plate with information on the product to be placed in a queue in the merchandiser, not shown, and an almost vertical lower area joined to the upper area. Notches are formed in the lateral edges of the rear wall 67 of the compartment 66 adapted to receive the flanges of the hook 65 to enable the compartment to be nested and slide along the front wall 64 until the upper part of the compartment is level with the upper edge of the front end of the merchandiser. Shoulders 68 are provided for this purpose, defining the upper end of each of the lateral notches formed in the rear wall 67 of the information compartment.

A generally L-shaped strip member 70 with a horizontal flange 71 is adapted to be glued or otherwise fixed to the front edge of the linear type shelving and extending over at least part or preferably all of its height. The strip member 70 has a vertical flange 72 halfway up which is a horizontal groove 73 opening inwardly and extending over the full length of the vertical flange. The upper part 74 of the vertical flange of the strip member tapers from an area just above the groove towards its upper end.

Each of the merchandisers is therefore adapted to be nested on the vertical flange 72 by inserting the vertical flange 72 into the slot 69 defined behind the front wall 64 which projects cantilever fashion from the front of the casing of the merchandiser and by moving the merchandiser downwards in the direction of the arrow F1 in FIG. 16, so that the reduced thickness latch 61 tends to open, in other words flexes towards the front as a result of the tapered upper part of the vertical flange until it is engaged in the groove 73 of the vertical flange. The ribs 60 on a merchandiser can be guided in the grooves 61 of an adjacent merchandiser on attachment to the strip member 70 as shown in FIG. 16 or on removing one or more merchandisers already in place on the strip member. Once nested with the strip member the merchandisers may be moved to their required position on the shelving.

The customer does not usually have access to the latch 61 in the notch 63, given that the information compartment 66 covers all of the notch 63 in the front 64 of the merchandiser. On the other hand, the operative responsible for laying out the shelving can modify the arrangement of one or more merchandisers because an opening 67A in the upper edge of the front end of the merchandiser provides access to the rear surface of the latch 61.

On inserting a screw driver or a similar flat member into the hole 67A, the free end of the latter moves down the slope of the upper part 74 of the vertical flange 72 and is then inserted in the latch 61 to bend the latch forward to release it from its engagement with the upper flank of the groove 73 formed in the vertical flange. The operative can then remove the merchandiser to return it to stores or to insert it between two other merchandisers on the same or another shelf, for example.

The merchandisers associated with the strip member are preferably of the type shown in FIGS. 10 through 15. It goes without saying that the advantages of using a strip member of this kind with a set of merchandisers do not depend on this particular clamper mechanism or on the use of any clamper mechanism. The set of merchandisers must include a slot for engagement with the vertical flange of the strip member, but the casing may otherwise be of any known construction.

It goes without saying that the present invention has been described by way of non-limiting example only and that any modification may be made thereto without departing from the scope of the invention.

What I claim is:

1. Queued object merchandiser comprising a channel adapted to receive partly nested objects forming a queue, said channel being provided with a clamp/pusher member fastened to a foot member adapted to slide in a guide slot and associated with a return spring urging it towards an anterior abutment wall, the foot member of the clamp/pusher member being fastened to a slide member disposed in a central guide passage disposed under a bottom of the channel, the return spring being coupled to the slide member and there being provided to either side of the central passage two side passages, the return spring describing at least an outward run in each of the side passages between at least one direction-changer pulley wheel and an anchor point.

2. Merchandiser according to claim 1 wherein said return spring describes an outward and a return run in each of said side passages.

3. Merchandiser according to claim 1 wherein the return spring direction-changer pulley wheels have vertical axes so that the spring as a whole is held in a generally horizontal plane defined by the carriage coupling member.

4. Merchandiser according to claim 1 wherein the slider is a carriage mounted on balls adapted to bear on three walls of the central guide passage.

5. Merchandiser according to claim 1 wherein the slide member is a carriage mounted on rollers.

6. Merchandiser according to claim 1 wherein said slide member comprises a profiled member with angle-irons cooperating with slideways of said central passage.

7. Merchandiser according to claim 1 comprising a base module and a variable number of extension modules, and in which each extension module is adapted to couple to any previous module by the nesting of anterior partition elements with posterior lugs with studs of the previous module.

8. Merchandiser according to claim 7 in which the anterior partition elements of each extension module block off the lateral passages extending into them and an end plate is adapted to close the channel at the rear of the last extension module.

9. Merchandiser according to claim 1 wherein there is provided in front of the anterior abutment wall a spare location adapted to receive an object separate from the queue.

10. Merchandiser according to claim 1 wherein a direction-changer guide is provided under the slide member to guide and change the direction of the return spring in the central passage.

11. Merchandiser according to claim 10 further comprising at least one retainer abutment disposed laterally away from the direction-changer guide, the distance between the direction-changer guide and each retainer abutment being less than the diameter of the return spring over at least part of the longitudinal length of said direction-changer abutment.

12. Set of merchandisers for queued objects, each merchandiser comprising a channel adapted to receive a queue of partly nested objects, said channel being provided with a clamp/pusher member fastened to a foot member adapted to slide in a guide slot and associated with a return spring urging it towards an anterior abutment wall, the foot member of the clamp/pusher member being fastened to a slide member in a central guide passage formed under the bottom of the channel, the return spring being attached to the slide member, and a strip member adapted to be fixed to shelving and incorporating a flange adapted to cooperate with a slot formed in the front part of each of the merchandisers in order to hold them aligned side by side with each other along the shelving.

13. Set of merchandisers according to claim 12 wherein each merchandiser further comprises a latch on one side of the slot adapted to engage in a groove formed in said strip member flange.

14. Set of merchandisers according to 13 wherein an information compartment is adapted to be mounted on the front end of each of the merchandisers and masks the latch of the corresponding merchandiser and in which an access opening is formed in each merchandiser in line with the latch to enable the latter to be disengaged from the groove in said flange and the merchandiser to be removed from the strip member.

15. Set of merchandisers according to claim 12 wherein said strip member is generally L-shaped comprising a horizontal flange adapted to be fixed to the shelving, the above-mentioned flange being a vertical flange.

16. Set of queued object merchandisers each comprising a channel adapted to receive a partly nested queue of objects, a generally L-shaped strip member comprising a substantially horizontal flange adapted to be fixed to the shelving and a substantially vertical flange adapted to be inserted into a slot formed in the front part of each of the merchandisers in order to hold them aligned with each other along the shelving, snap-fastener means being provided in communication with the slot or adapted to cooperate with a groove formed in the vertical flange in order to enable each of the merchandisers to be snap-fastened onto the strip member.

17. Set of merchandisers according to claim 16 wherein the outside surface of one of the side walls comprises male means adapted to operate with complementary female means disposed on the outside surface of the other lateral wall of each merchandiser.

* * * * *

UNITED STATES PATENT AND TRADEMARK OFFICE

CERTIFICATE OF CORRECTION

PATENT NO. : 5,111,942

DATED : May 12, 1992

INVENTOR(S) : Didier BERNARDIN

It is certified that error appears in the above—identified patent and that said Letters Patent is hereby corrected as shown below:

On the title page, item [22], change the filing date from March 25, 1991 to April 25, 1991.

Signed and Sealed this

Twelfth Day of April, 1994

Bruce Lehman

BRUCE LEHMAN

*Commissioner of Patents and Trademarks*

*Attest:*

*Attesting Officer*